US009651329B2

(12) United States Patent
Hittmann

(10) Patent No.: US 9,651,329 B2
(45) Date of Patent: May 16, 2017

(54) TRIGGER DEVICE FOR A SEMI-AUTOMATIC HANDGUN

(71) Applicant: Karl Hittmann, Nussdorf (AT)

(72) Inventor: Karl Hittmann, Nussdorf (AT)

( * ) Notice: Subject to any disclaimer, the term of this patent is extended or adjusted under 35 U.S.C. 154(b) by 0 days.

(21) Appl. No.: 14/848,622

(22) Filed: Sep. 9, 2015

(65) Prior Publication Data

US 2016/0069630 A1 Mar. 10, 2016

(30) Foreign Application Priority Data

Sep. 9, 2014 (AT) ..... A 50620/2014

(51) Int. Cl.

| | |
|---|---|
| ***F41A 19/00*** | (2006.01) |
| ***F41A 19/10*** | (2006.01) |
| ***F41A 19/02*** | (2006.01) |
| ***F41A 19/12*** | (2006.01) |

(52) U.S. Cl.
CPC ..... *F41A 19/10* (2013.01); *F41A 19/02* (2013.01); *F41A 19/12* (2013.01)

(58) Field of Classification Search
CPC ..... F41A 19/02; F41A 19/67
See application file for complete search history.

(56) References Cited

U.S. PATENT DOCUMENTS 2,986,073 A 5/1961 Godar
3,292,492 A * 12/1966 Sturtevant ..... F41A 17/46 89/128
3,440,925 A * 4/1969 Vervier ..... F41A 19/02 89/129.02
4,095,507 A * 6/1978 Close ..... F41A 19/02 89/129.02
4,450,751 A * 5/1984 Thevis ..... F41A 17/46 89/129.02
4,594,934 A * 6/1986 Holstein ..... F41A 19/02 89/129.02
4,693,169 A * 9/1987 Beretta ..... F41A 19/02 89/129.02
4,941,394 A 7/1990 Zedrosser et al.

FOREIGN PATENT DOCUMENTS

CH 626717 A5 * 11/1981 ..... F41A 19/02
DE 655334 1/1938

* cited by examiner

*Primary Examiner* — Gabriel Klein
(74) *Attorney, Agent, or Firm* — Dykema Gossett PLLC

(57) ABSTRACT

The invention relates to a trigger device for a semi-automatic handgun, including a locking element swivel-mounted around a first axis and acting on a trigger element via a locking face, and a shot limitation device, which has a control element with locking or control faces defining at least two locking positions for a pawl swivel-mounted around a second axis.

To allow limited and precisely metered firing for rapid-fire sequences, it is provided that the control element is formed by a sear arranged in the path of action between a trigger and the trigger element, which acts on the trigger element through the locking element and the pawl swivel-mounted on the locking element around the second axis.

17 Claims, 14 Drawing Sheets

TRIGGER DEVICE FOR A SEMI-AUTOMATIC HANDGUN

BACKGROUND OF THE INVENTION

The invention relates to a trigger device for a semi-automatic handgun, comprising a locking element swivel-mounted around a first axis having an effect on a trigger element via a locking face and a shot limitation device, which has a control element with at least two locking positions for a locking face or control face defining a pawl around a second axis.

From EP 0 362 188 A2, a trigger mechanism for automatic handguns is known, which allows continuous fire with a certain number of rounds. The number of rounds is defined by the shot limitation device. It is virtually impossible to deliberately interrupt or dose the number of rounds before firing the total predefined number of rounds within a burst.

Specification DE 1 129 873 B describes a shot limiter for automatic weapons, which is actuated by the movement of the lock and allows a geared member to be advanced by one cog for each shot, which causes an interruption after a certain number of shooting actions, by triggering a mechanical connection in the trigger mechanism. An actuating lever activated by the lock is designed as an integral element and guided through guideways and return elements in such a way that it switches the cogs of the geared member with its catch due to a compound pushing and pivoting motion. Furthermore, a latch is provided, which retains the geared member, which is under the influence of an elastic member, after each shifting of the same. After the trigger has been engaged, a pre-set number of rounds is released completely automatically, wherein the shot sequence cannot be interrupted by the shooter.

DE 655 334 C describes a device for automatic interruption of the free-flow fire of automatic weapons, wherein a certain number of rounds can be pre-set before triggering a volley of shots. In addition, there is just one single pressure point for each shot sequence, wherein the predefined number of consecutive shots is triggered after pressing the pressure point without the shooter having the chance of an interruption to the shots.

The described devices are well-known multi-trigger systems, as constitutes a three-shot automatic for example. The multi-triggers are a trigger system, with which an adjustable or predefined shot rate, for example a three-shot automatic—three shots consecutively—is automatically discharged by the system. The time between the first, second and third shot is identical and predefined by the trigger system. To trigger this procedure, one single pressure point is overcome, whereupon three or more shots are fired. This procedure cannot be interrupted as it is a fully-automated process and, consequently, a fully-automated weapon system.

SUMMARY OF THE INVENTION

The object of the invention is to provide a trigger device for handguns, which allows a limited and precisely metered firing for rapid-fire sequences.

This is achieved in such a way that the control element is formed by a sear arranged in the path of action between a trigger and the trigger element, which exerts an influence on the trigger element through the pawl and the locking element, wherein the second axis is preferably spaced from the first axis, wherein the pawl is swivel-mounted on the locking element around the second axis.

In doing so, a pressure point of the trigger is assigned to each shot, so that the shooter can interrupt the shot sequence at any time between the two pressure points. This allows the shooter to have precisely metered firing with quick-fire sequences, wherein the firing can be deliberately interrupted by the shooter within a shot sequence at any time.

The trigger element can be formed by a striker or a firing pin holding element.

It is particularly advantageous if the pawl is designed as a two-armed lever, whose first lever arm forms an initial contact face cooperating with the control face of the control element and the second lever arm forms a second contact face cooperating with a control face of the trigger element.

The sear can be formed operatively connected with the trigger and separate to this. Preferably the sear is operatively connected with the trigger through a transmission element that is preferably designed as a single-sided transmission lever, wherein the trigger can be operatively connected with the transmission element via a pressure nose. Through the dimensioning of the lever arms of the transmission lever and the pressure nose, the trigger forces and trigger points can be designed very flexibly. As an alternative to a multi-part design, it is also possible to design the sear as a single piece with the trigger. This makes it possible to keep the number of parts very low.

For example, the sear can be slidably mounted in a housing. The housing can be the actual housing of the handgun, a gripstock or the frame of an exchangeable module for the handgun. However, it is particularly advantageous if the sear is swivel-mounted in a housing, wherein the trigger element and the sear are preferably swivel-mounted around the same pivot point. This also makes it possible to retrospectively install and retrofit the trigger device in accordance with the invention in established handguns.

A very compact structure can be achieved if the locking element is swivel-mounted on the sear. However, it is also conceivable that the locking element is swivel-mounted in the housing.

The control element preferably has at least one toothed segment with at least two locking teeth defining the locking positions. The pawl latches into one of the locking teeth when the trigger element moves. Alternatively, it can also be provided that the control element has a sliding guide with at least two locking deflectors defining the locking positions, wherein a sliding block is preferably assembled on the first lever arm, which is forcibly guided in the sliding guide.

To use the available space optimally, it can be advantageous if the sear is designed to have multiple parts, wherein the sear preferably has a first toothed segment non-rotatably connected with the trigger and a second toothed segment non-rotatably connected with the control element, which is in tooth meshing with the first toothed segment.

BRIEF DESCRIPTION OF THE DRAWINGS

The invention will be explained in more detail below by reference to the non-restrictive drawings, which schematically show as follows.

DETAILED DESCRIPTION OF EMBODIMENTS

Figure 1:
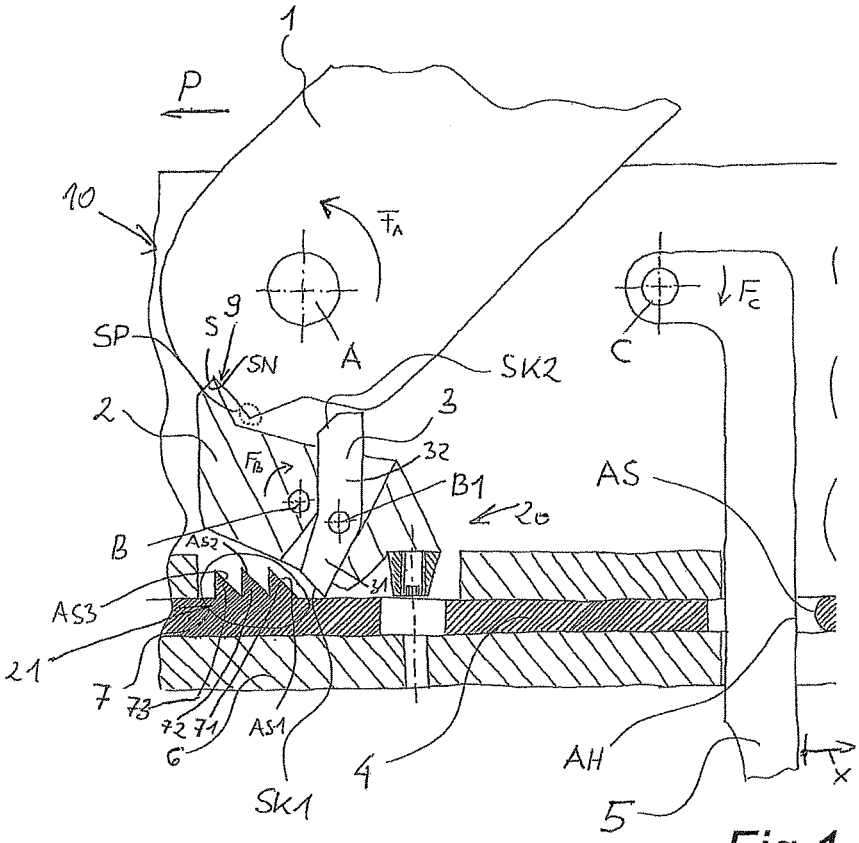
FIG. 1 shows a trigger device in accordance with the invention for a handgun in a first embodiment in a first position of the trigger.

Functionally-identical elements are labeled in the embodiments with the same reference signs.

The trigger devices 10 for a handgun shown in the embodiments each have a trigger element 1, a locking element 2, a pawl 3, a sear 4 and a trigger 5. A housing is labeled using reference numeral 6. This can be the housing of the handgun, a gripstock or the frame of a replaceable module for the trigger device 10. In the latter case, the module for the trigger device can be used interchangeably in the gripstock of the handgun. In the embodiments, the trigger element 1 is formed by a striker swivel-mounted around a pivot point A in housing 6, which is pre-stressed counterclockwise by a spring (not shown in closer detail), as is implied by arrow $F_A$. The trigger 5 is swivel-mounted around a pivot point C in housing 6 and pre-stressed in a clockwise direction by a spring force $F_C$.

With the described trigger devices 10, semiautomatic fire and quick-fire sequences (QSF) can be realized, and possibly also sustained fire (fully automatic). The setup of these types of firing is not part of the invention and is therefore not explained in further detail. In the following, only the quick-fire sequence will be described.

To realize the quick-fire sequence function, the trigger device 10 has a shot limitation device 20, which is formed by a control element 21, the locking element 2 swivel-mounted around a first axis B and the pawl 3. The locking and control faces AS1, AS2, AS3 of the control element 21 define at least two locking positions a, b, c for the pawl 3. Each locking position a, b, c defines a pressure point for trigger 5. During a trigger movement of the trigger 5, the locking positions a, b, c defined by the locking or control faces AS1, AS2, AS3 result in several pressure points.

Figure 6:
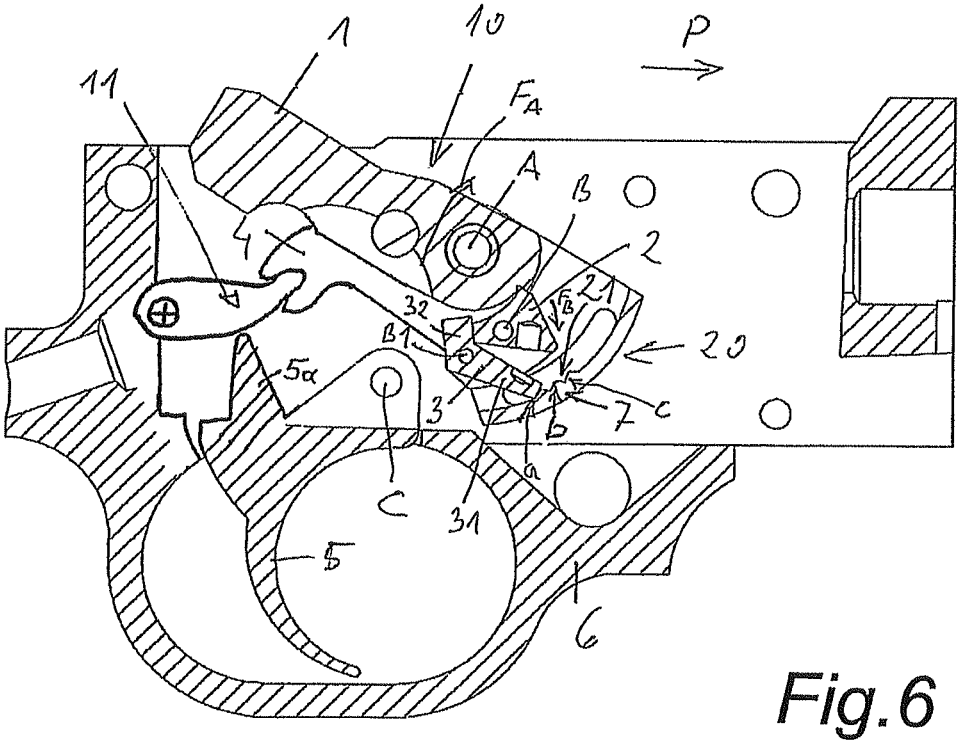
FIG. 6 shows a trigger device in accordance with the invention for a handgun in a third embodiment.
Figure 7:
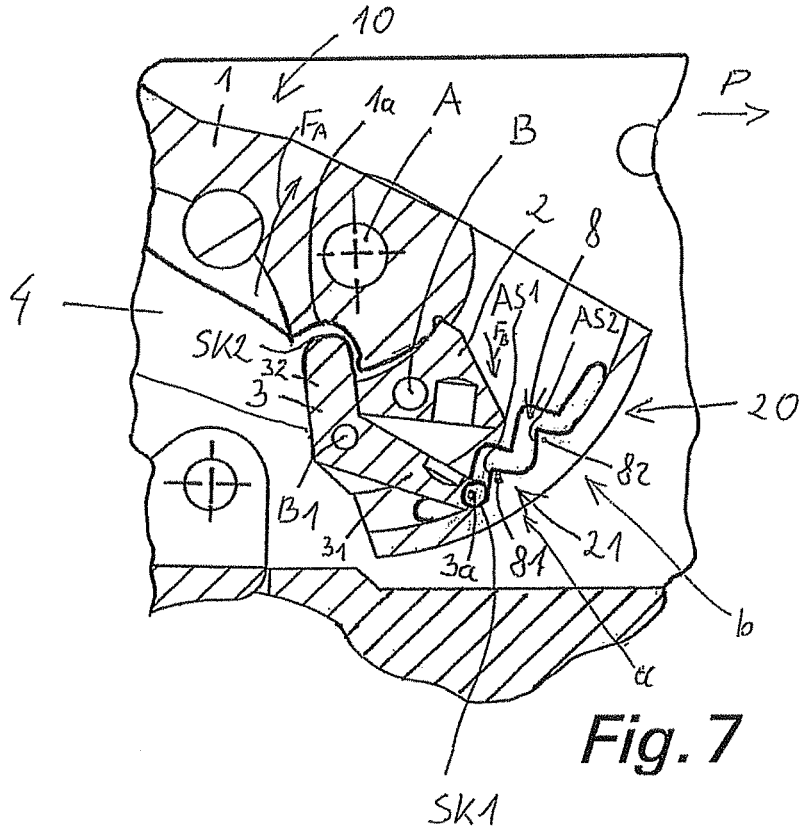
FIG. 7 shows a trigger device in accordance with the invention for a handgun in a fourth embodiment.
Figure 8:
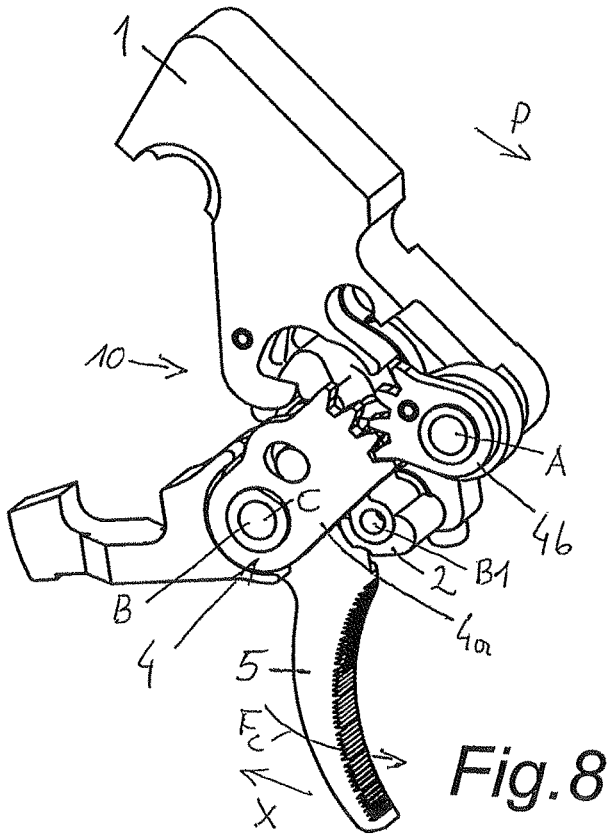
FIG. 8 shows a trigger device in accordance with the invention for a handgun in a fifth embodiment in an angled view.
Figure 9:
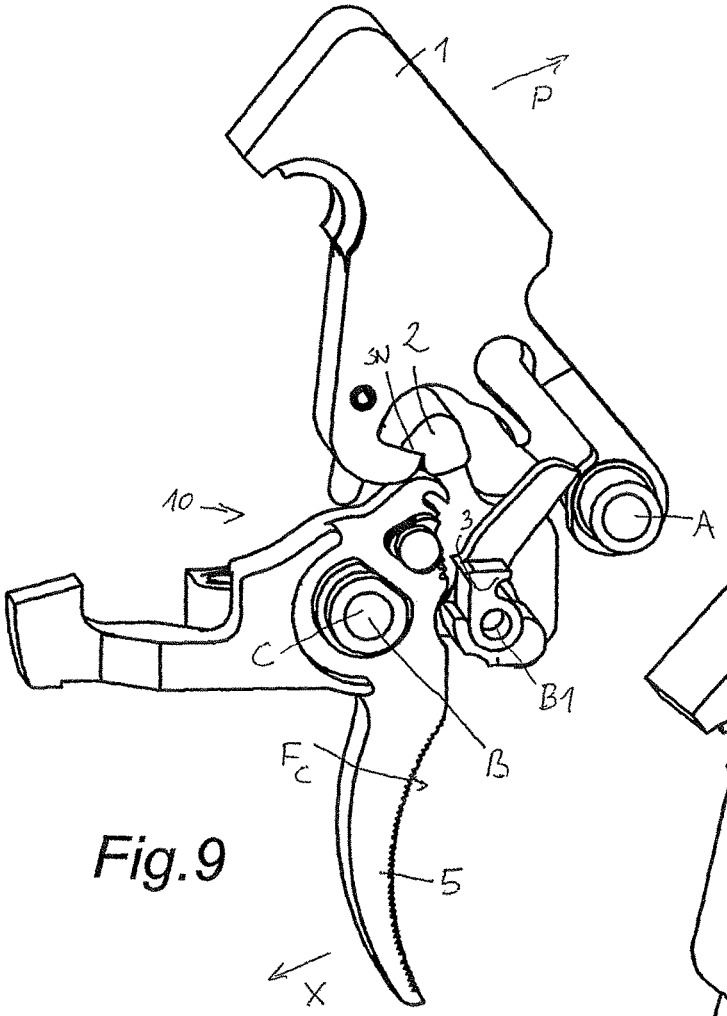
FIG. 9 shows said trigger device in an angled view with removed control element.
Figure 10:
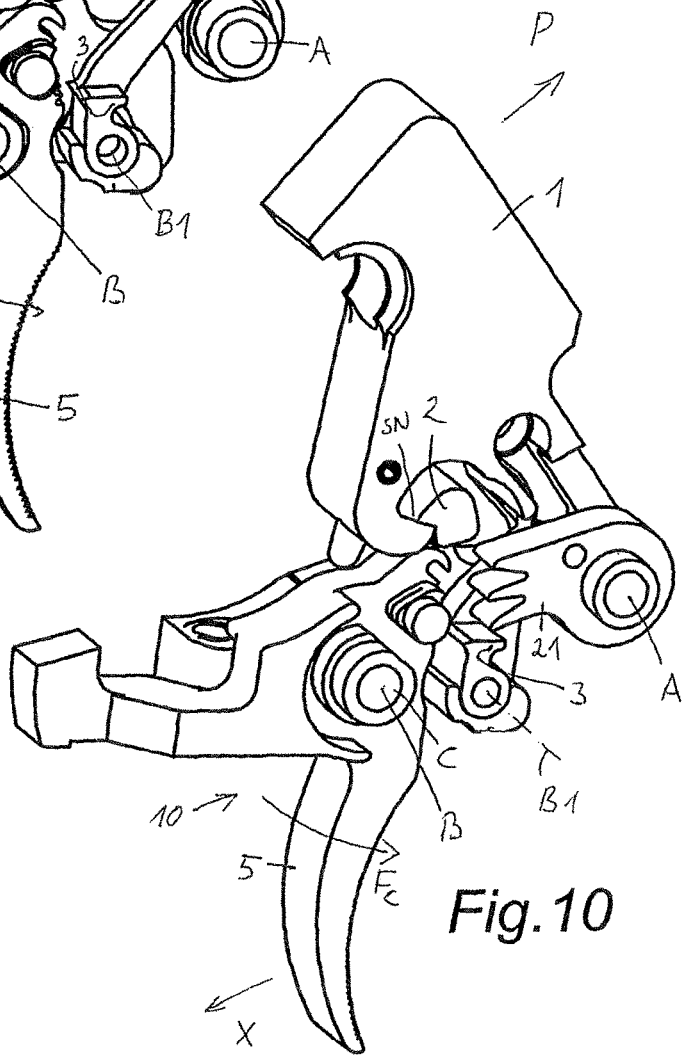
FIG. 10 shows said trigger device in an angled view with removed sear.

The locking or control faces AS1, AS2, AS3 of the control element 21 can be formed by locking teeth 71, 72, 73 of a toothed segment 7 (FIG. 1 to FIG. 6) or sliding deflectors 81, 82 of a sliding guide 8 of sear 4 (FIG. 7). The locking element 2 is prestressed in a counterclockwise direction into that in FIG. 5 to FIG. 7 by a spring force $F_B$ in FIGS. 1 to 4. Due to the spring load, self-locking occurs between trigger element 1 and locking element 2. The pawl 3 engaging in the locking positions a, b, c of the locking or control faces AS1, AS2, AS3 is designed as a two-sided lever with a first lever arm 31 and a second lever arm 32 and swivel-mounted in the locking element 2 around a second axis B1. When pivoting the locking element 2, the second axis B1 experiences a rotary motion around the first axis B.

For the quick-fire function, the following locking faces are important:

SK1 First contact face of pawl 3

SK2 Second contact face of pawl 3

AS1, AS2, AS3 Locking or control faces of locking teeth 71, 72, 73 or the sliding deflectors 81, 82 of sear 4

SP Control face of trigger element 1

S Locking face of trigger element 1

SN Locking face of locking element 2

Furthermore, the contact faces between trigger 5 and sear 4 are labeled with AS or AH.

Arrow P highlights the direction of shooting of the handgun.

In the following, the trigger process will be explained on the basis of the first embodiment shown in FIG. 1 to FIG. 4. FIGS. 1 to 4 show various stages of the trigger process.

In this first embodiment, the sear 4 is formed as a displaceably mounted slider or as a rod in housing 6. The first axis B for the swivel-mounted bearing of locking element 2 is designed to be fixed within the housing.

I—Standby Mode (FIG. 1).

The trigger element 1 is held in the fully-tensioned position by locking element 2. The trigger element 1 is in its tensioned standby position, wherein the locking faces S or SN of the trigger element 1 and the locking element 2 are in contact. The spring-loaded sear 4 is in the far-left standby position of FIG. 1. The spring-loaded trigger 5 is in its standby position.

Figure 2:
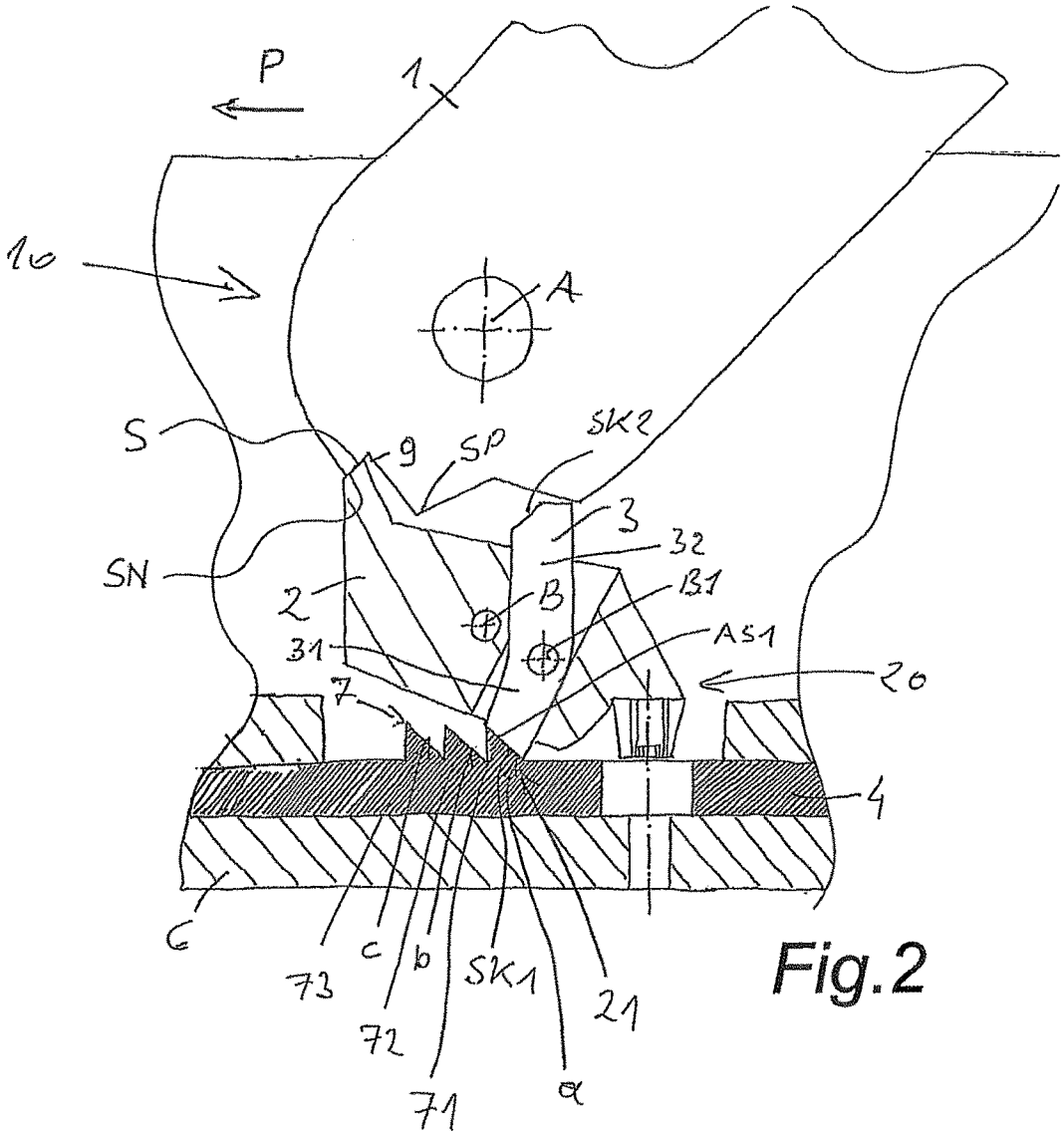
FIG. 2 shows said trigger device in a second position of the trigger.

II—Pressure Point (FIG. 2)

The shot-triggering procedure begins:

The trigger 5 is moved by the shooter in the direction x against the spring force $F_C$ in FIG. 1, wherein it is pivoted counterclockwise around pivot point C. The trigger 5 makes contact with the contact face AH on the contact face AS of sear 4. The trigger 5 and sear 4 begin to move together in the direction x. In further consequence, the locking face AS1 of the first tooth 71 meets the first contact face SK1 of the pawl 3. The pawl 3 can be spring-loaded in the direction of control faces AS1, AS2, AS3 (i.e. in a counterclockwise direction in FIG. 1 to FIG. 4). The locking element 2 is moved from its standby position, in a counterclockwise direction. Due to the shape of the corresponding locking faces AS1 and SK1, a rotary movement of the locking element 2 occurs around the first axis B.

Figure 3:
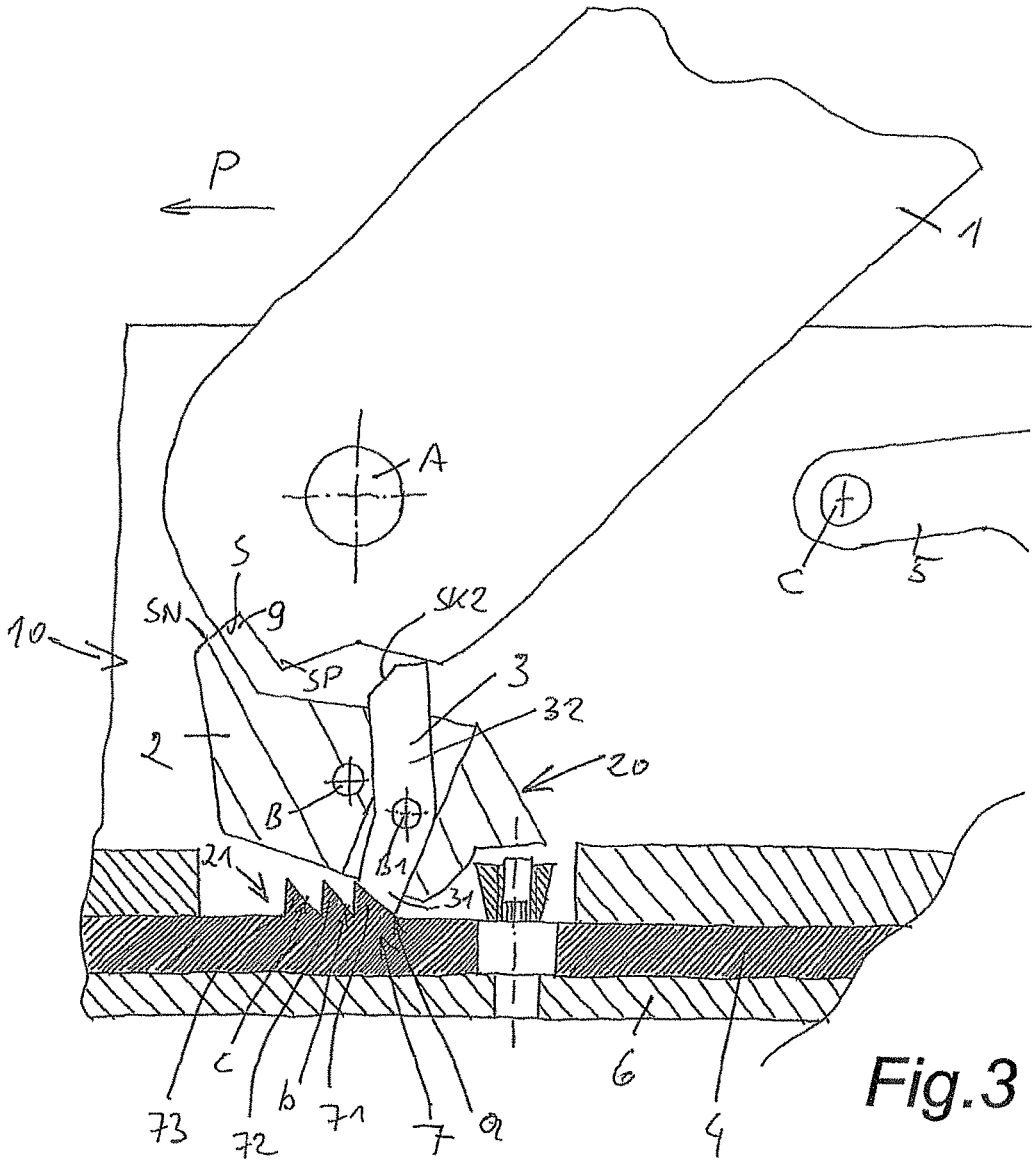
FIG. 3 shows said trigger device in a third position of the trigger.

III—Trigger Moment (FIG. 3)

The locking element 2 is rotated around the first axis B in a counterclockwise direction via the sear 4 due to the continuous force effect of the shooter on the trigger 5, wherein the locking face S of the locking element 2 slides radially to the outside along the locking face SN of the latching recess 9 of the trigger element 1 in an counterclockwise direction in relation to the first axis B, until the locking faces S and SN lose their mutual contact (see FIG. 3). The spring-loaded trigger element 1 now begins to turn in a counterclockwise direction through the spring force $F_A$ and subsequently encounters the firing pin (not shown), which executes the energy transfer on the percussion cap.

Figure 4:
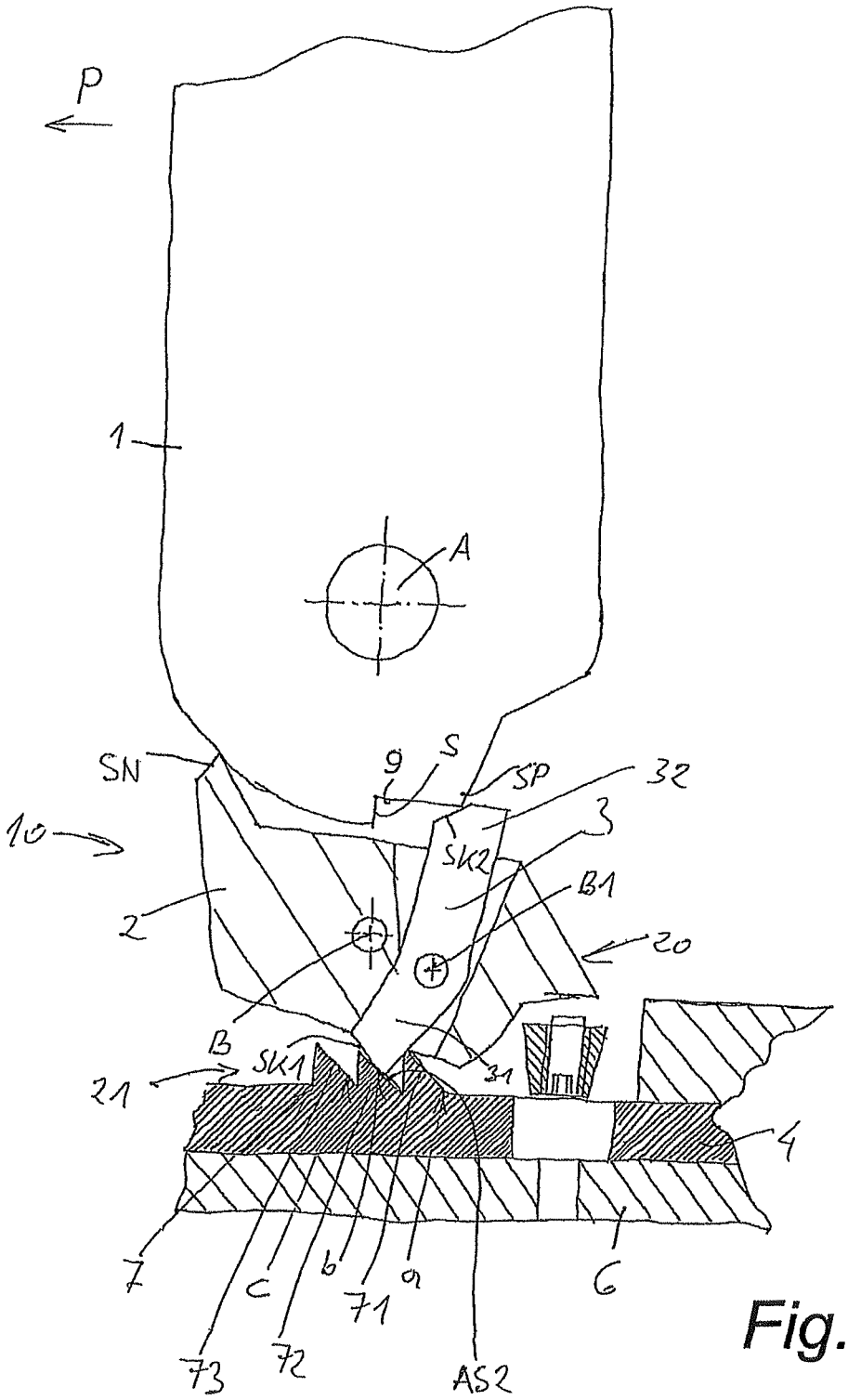
FIG. 4 shows said trigger device in a fourth position of the trigger.

IV—Triggering for the 2nd or 3rd Shot (FIG. 4)

As part of the rotary movement of the trigger element 1 around the pivot point A, the control face SP of trigger element 1 comes into contact with the second contact face SK2 of pawl 3. The pawl 3 begins to rotate around the second axis B1 in the clockwise direction, wherein the first contact face SK1 of pawl 3 slides along to the locking face AS1 of the first locking tooth 71, until it is released. Due to a backward movement of a breech (not shown) in X direction, the trigger element 1 is rotated clockwise around pivot point A against the spring force $F_A$. Due to the spring load of locking element 2, this is pressed against the trigger element 1 in the clockwise direction. If the movement of the trigger element 1 clockwise exceeds the locking face SN of locking element 2, the locking element 2 pivots back into the latching recess 9. As soon as the breech moves in the opposite direction in the direction of the barrel, the trigger element 1 is moved in the counterclockwise direction by the spring force $F_A$, wherein the locking faces S and SN of locking element 2 or of trigger element 1 come back to be positioned on top of each other. The trigger element 1 is now back in its tensioned standby position.

If the shooter operating the handgun exerts another tightening on the trigger 5, then the sear 4 is shifted further in the X direction, wherein the first contact face SK1 makes contact with the locking face AS2 of the second tooth 72 and the locking element 2 is rotated by the sear 4 around the first axis B in a counterclockwise direction and is moved radially outwardly from the latching recess 9, so that the released trigger element 1 is rotated by the spring force $F_A$ in a counterclockwise direction and in further consequence the energy transfer on the percussion cap can be executed for the second shot by hitting the firing pin. In a similar way, after the end of the cycles for the first and second shots, the cycle for the third shot can be initiated through the locking face AS3 of the third locking tooth 73.

Should the trigger process be interrupted by the shooter, wherein the trigger 5 remains in its position or moves around the pivot point C in a counterclockwise direction in the direction of its standby position, then the sear 4 is returned to its standby position by spring force, wherein the pawl 3 is force-controlled due to its design and rotated in the clockwise direction around pivot point B1 and slides over the locking faces AS3 to AS1.

Figure 5:
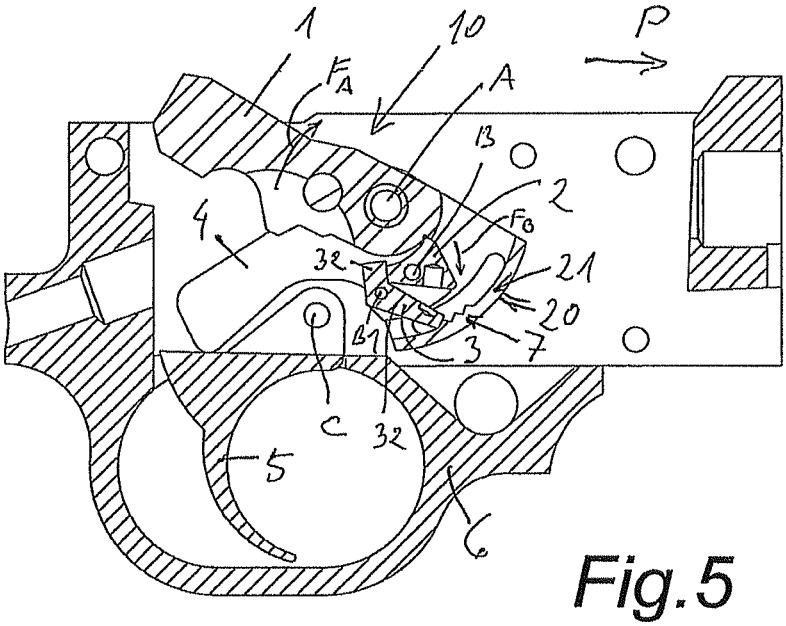
FIG. 5 shows a trigger device in accordance with the invention for a handgun in a second embodiment.

FIG. 5 shows a second embodiment of a trigger device 10, which is different to the first embodiment in FIG. 1 to FIG. 4 in that the sear 4 now forms a housing for the locking element 2—the locking element 2 is now pivot-mounted around the first axis B directly in sear 4. The sear 4 itself can be swivel-mounted around pivot point A. This makes it possible to retrofit the entire trigger device 10 without further reconfiguration work in existing handguns. Furthermore, this embodiment is different to that of FIG. 1 to FIG. 4 in that the control face SP and locking face S of trigger element 1 can coincide. The sear 4 can be directly controlled by trigger 5. It is also possible to mount the trigger 5 directly on sear 4 or to design this to be integral therewith.

By contrast, FIG. 6 shows another embodiment, which is different to that shown in FIG. 5 in that the triggering of the sear 4 occurs by the trigger through a transmission element 11, which is formed here as a one-sided transmission lever. Through the appropriate dimensioning of the lengths of the lever arms of the transmission lever, transmissions or reductions and consequently different angles of rotation of the trigger 5 or the sear 4 can be realized. The necessary trigger forces can be adjusted through the size and position of an actuating nose 5*a* provided on the trigger 5. The actuating nose 5*a* can also be designed as a separate element, wherein different leverage forces and consequently different trigger resistances can be realized through the provision of different mounting points.

Furthermore, FIG. 7 shows an embodiment, in which the control element 21 of the shot limitation device 20 has a sliding guide 8 with at least two sliding deflectors 81, 82 defining the locking positions a, b. Each of the locking positions a, b defines the pressure point for a single firing during the quick-fire function within a trigger movement of the trigger 5. In the example shown in FIG. 7, two cartridges per trigger movement would be ignited with the quick-fire function, as two control faces AS1, AS2 are available which extend upwardly in an angled manner. On the first lever arm of the pawl 3, a sliding block 3*a* is fitted, which is forcibly guided into the sliding guide 8. The sliding block 3*a* can be fixed or rotatably—for example designed as a roller—connected with the pawl 3. Upon pressing the trigger 5, the sear 4 begins to rotate in a clockwise direction due to the direct effect of the trigger 5 as described on the basis of FIG. 5 on the sear 4 or the indirect effect of the trigger 5 as described in FIG. 6 via the transmission element 11. The sliding block 3*a*, a component of the pawl 3, moves along the sliding guide 8 until the sliding block 3*a* meets the first inclined control face AS1; on the basis of the work angle of the first control face AS1, static friction occurs between the sliding block 3*a* and the control face AS1, whereby the locking element 2 begins to rotate around the pivot point B fixed to the housing through the continuous application of force. The pivot point B1 is—as with the previously described embodiments—connected with the locking element 2. The pressure point that is typical for the weapon occurs when the sliding block 3*a* strikes the first sliding deflector 81. After the trigger element 1 has been released from the locking element 2, the trigger element 1 moves in a clockwise direction.

In the contact range with the pawl 3, the trigger element 1 has a recess 1*a*, with which the pawl 3 is sometimes forcibly triggered. Due to the application of force of the recess is of the trigger element 1, the first lever arm 31 of the pawl 3 moves "upwards" in the direction of the trigger element 1, i.e. counterclockwise in FIG. 7. The trigger element 1 is moved backwards into the starting position after triggering the first shot by the breech (not shown) of the handgun. Due to the continuous application of force on the trigger 5 and the subsequent rotary movement of the sear 4, the pawl 3 moves "downwards" in a clockwise direction.

In the lower area of the sliding guide 8—shown in FIG. 7—the sliding block 3*a* meets the second upwardly inclined control face AS2—from this point the described process is repeated.

If the triggering process is interrupted and the trigger 5 is disengaged, the sliding block 3*a* moves back along the sliding guide 8 into its starting position. This is possible as the trigger element 1 in the lower section, in FIG. 7 left of recess 1*a,* is released. As a result, there is only a one-sided forced control of pawl 3. A movement of the pawl 3 counterclockwise at the exact interruption of the shot sequence is possible during a trigger movement in any pressure point.

FIG. 8 to FIG. 31 show a trigger device 10 in accordance with the invention in a fifth embodiment, wherein the sear 4 is designed to consist of multiple parts and has two toothed segments 4*a,* 4*b* with meshing teeth. The first toothed segment 4*a* is non-rotatably connected with the trigger 5. The second toothed segment 4*b* is non-rotatably connected with the control element 21. The first axis B for the rotary movement of locking element 2 rotary axis B and pivot point C of trigger 5 coincide. The second axis B1 for the swivel movement of the pawl 3 is found on the locking element 2 at a distance from the first axis B. The pawl 3 is designed as a single-armed lever and is prestressed by the spring 33 in the direction of the control element 21. The control element 21 also has several teeth 71, 72, 73 in this embodiment, which interact with the pawl 3.

In FIG. 11 to FIG. 31, the various phases I—VII of the trigger are shown.

Figure 11:
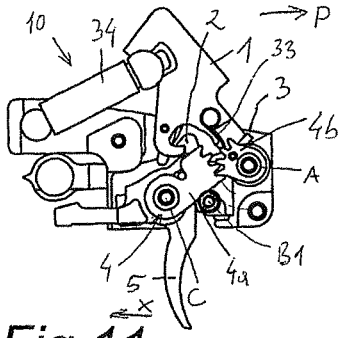
FIG. 11 shows said trigger device in an original position.
Figure 12:
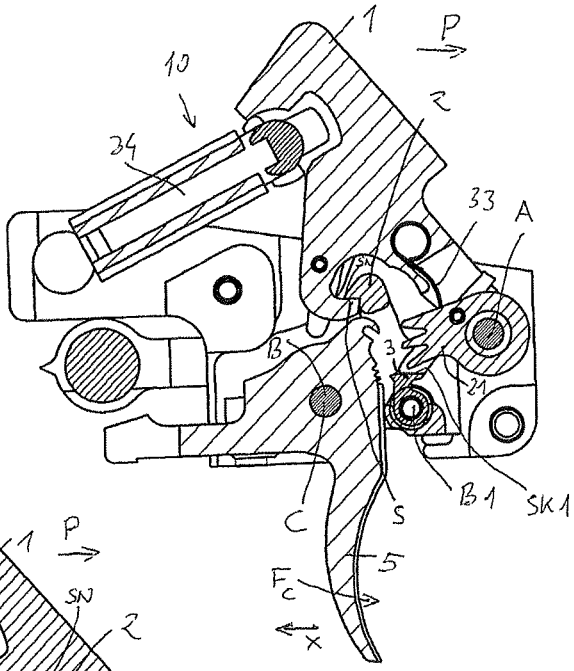
FIG. 12 shows said trigger device in the original position with removed sear.
Figure 13:
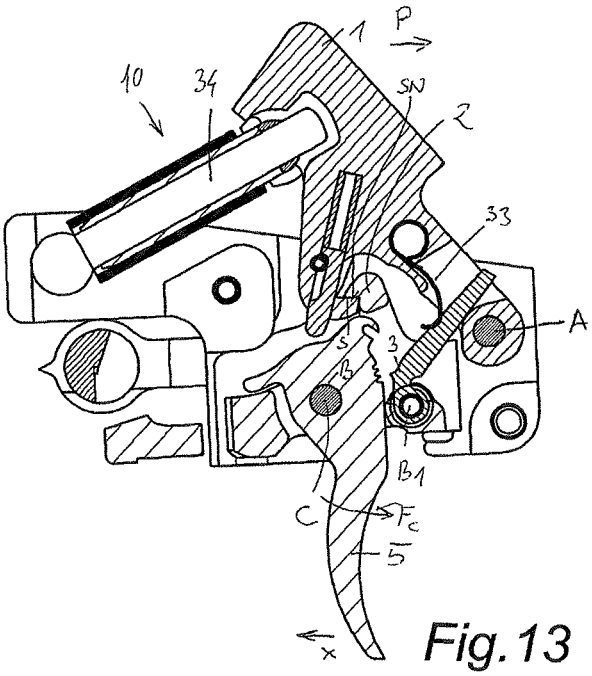
FIG. 13 shows said trigger device in an original position with removed control element.

I—Starting Position (FIG. 11 to FIG. 13)

The trigger element 1 is held in the fully-tensioned position by locking element 2. The trigger element 1 is in its tensioned standby position, wherein the locking faces S or SN of the trigger element 1 and the locking element 2 are in contact. The sear 4 and the spring-loaded trigger 5 are in their standby position.

Figure 14:
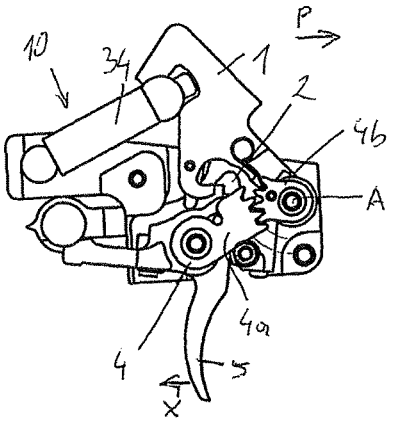
FIG. 14 shows said trigger device with fire discharge from the first tooth position.
Figure 15:
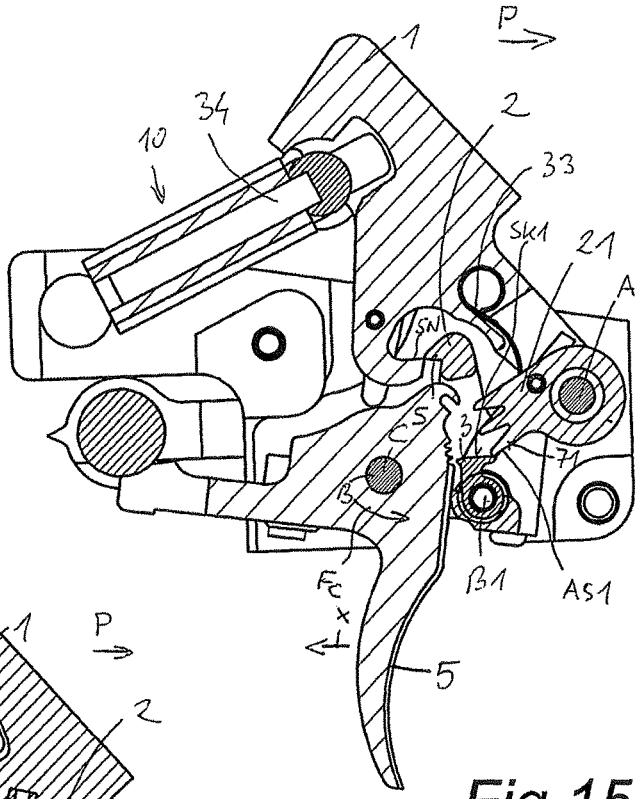
FIG. 15 shows said trigger device with fire discharge from the first tooth position with removed sear.
Figure 16:
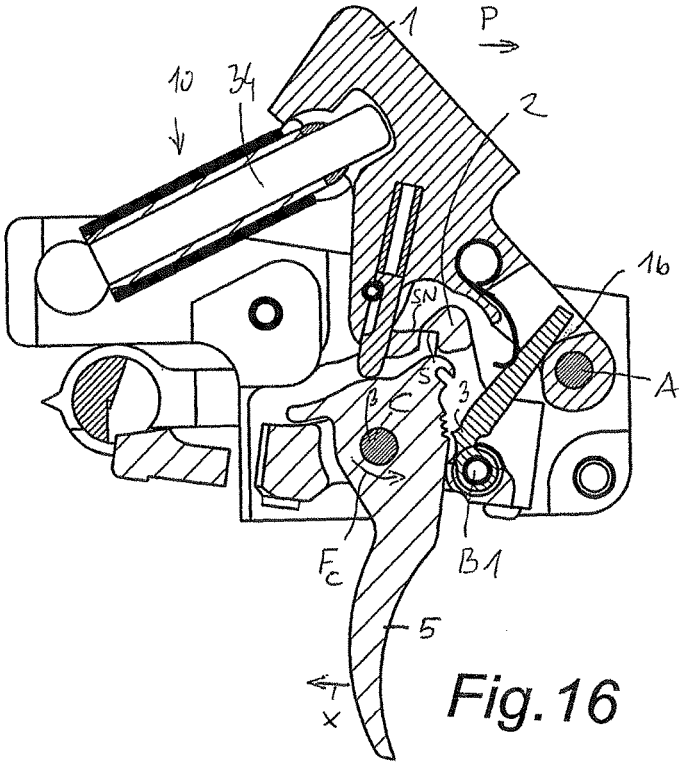
FIG. 16 shows said trigger device with fire discharge from the first tooth position with removed control element.

II—Firing of 1st Tooth (FIG. 14 to FIG. 16)

The shot-triggering procedure begins:

The trigger 5 is moved by the shooter in the direction x against the spring force $F_C$ in FIG. 1, wherein it is pivoted clockwise around pivot point C. The trigger 5 is non-rotatably connected with the first toothed segment 4*a* and begins to move against the spring resetting force $F_C$ around the first axis B together with said segment. In further consequence, the locking face AS1 of the first tooth 71 of the control element 21 meets the first contact face SK1 of pawl 3. The locking element 2 is moved from its standby position in a clockwise direction in FIG. 14 to FIG. 16. Due to the shape of the corresponding locking faces AS1 and SK1, a rotary movement of the locking element 2 occurs around the first axis B.

Figure 17:
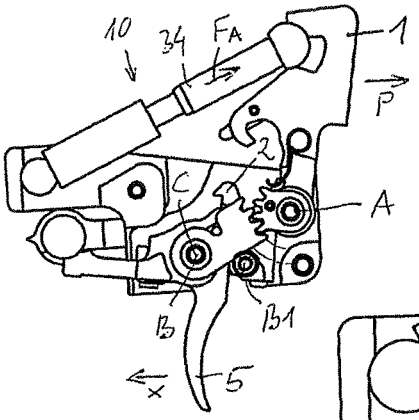
FIG. 17 shows said trigger device fired from the first tooth position.
Figure 18:
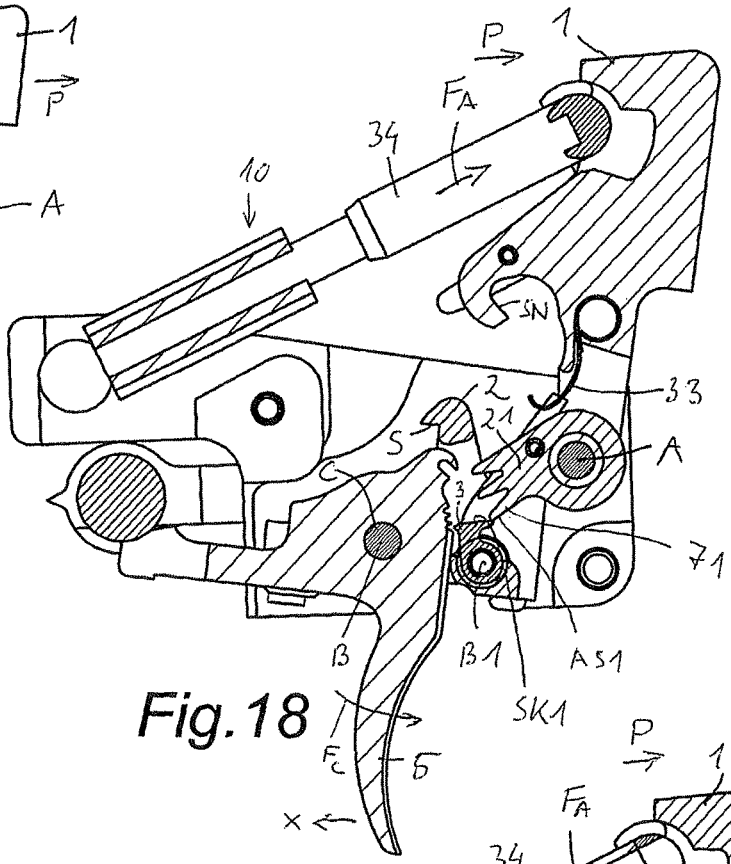
FIG. 18 shows said trigger device fired from the first tooth position with removed sear.
Figure 19:
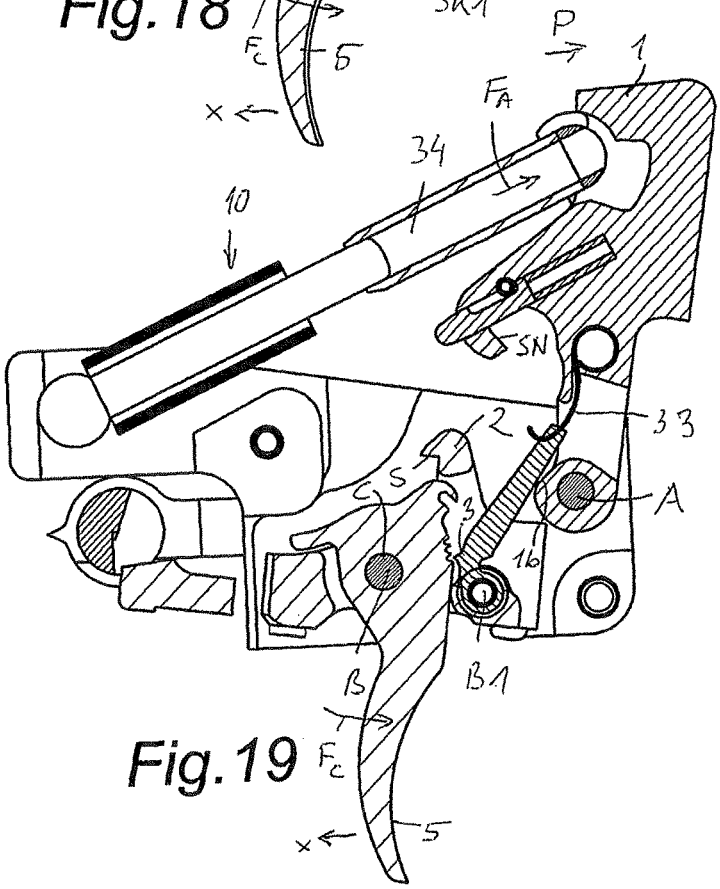
FIG. 19 shows said trigger device fired from the first tooth position with removed control element.

III—Fired 1st Tooth (FIG. 17 to FIG. 19)

The locking element 2 is rotated around the first axis B in a clockwise direction via the sear 4 due to the continuous force effect of the shooter on the trigger 5, wherein the locking face S of the locking element 2 slides radially to the outside along the locking face SN of the latching recess 9 of the trigger element 1 in a clockwise direction in relation to the first axis B, until the locking faces S and SN lose their mutual contact (see FIG. 17 to FIG. 19). The trigger element 1 stressed by the spring 34 now begins to turn around pivot point A in a clockwise direction through the spring force $F_A$ of spring 34 and subsequently meets the firing pin (not shown), which executes the energy transfer on the percussion cap.

The pawl 3 lies flat on trigger element 1 or is supported thereon.

If one considers the contact surface 1*b* of the trigger element 1 for the pawl 3 in the "trigger element tensioned" state (FIG. 14 to FIG. 16) and "trigger element fired" (FIG. 17 to FIG. 19), it can be determined that the radius of the contact surface 1*b* changes from "tensioned" to "fired"—i.e. becomes larger. This leads to the consequence that the pawl 3 is rotated somewhat counterclockwise, with a shot direction towards the right. This is technically necessary as coordination between the faces of locking element 2—trigger element 1 and pawl 3—control element 21 is difficult to coordinate in terms of time or mechanics and a "tilting" of the pawl 3 protects the components and reduces frictional force.

Figure 20:
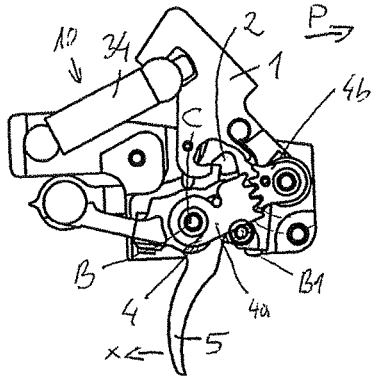
FIG. 20 shows said trigger device with fire discharge from the second tooth position.
Figure 21:
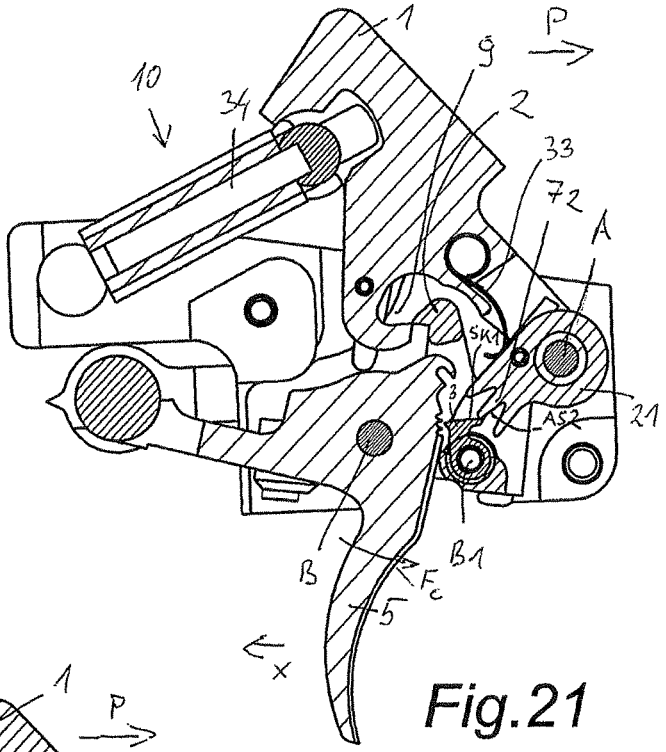
FIG. 21 shows said trigger device with fire discharge from the second tooth position with removed sear.
Figure 22:
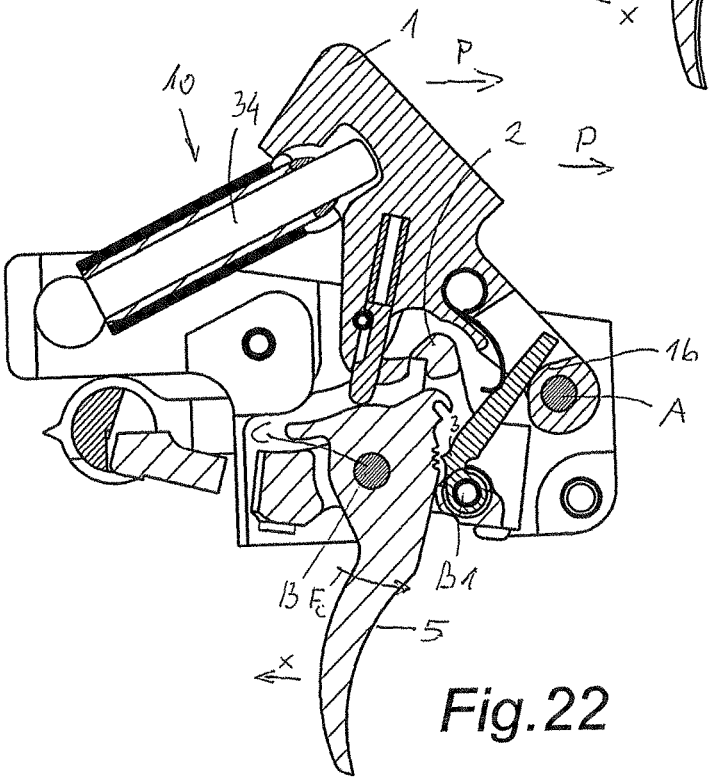
FIG. 22 shows said trigger device with fire discharge from the second tooth position with removed control element.

IV—Firing of 2nd Tooth (FIG. 20 to FIG. 22)

Due to a backward movement of a breech (not shown) in X direction, the trigger element 1 is rotated counterclockwise around pivot point A against the spring force $F_A$. Due to the spring load of locking element 2, it is pressed against the trigger element 1 in the clockwise direction. If the movement of the trigger element 1 counterclockwise exceeds the locking face S of locking element 2, the locking element 2 pivots back into the latching recess 9—the locking face S of locking element 2 comes back into contact with the locking face SN of trigger element 1. As soon as the breech moves in the opposite direction in the direction of the barrel, the trigger element 1 is moved in the clockwise direction by the spring force $F_A$, wherein the locking faces S and SN of locking element 2 or of trigger element 1 come back to be positioned on top of each other. The trigger element 1 is now back in its tensioned standby position.

The trigger 5 is moved by the shooter further in the direction x against the spring force $F_C$, wherein it is pivoted clockwise around pivot point C. The trigger 5 begins to move against the spring resetting force $F_C$ around the first axis B together with the first toothed segment 4*a*. In further consequence, the locking face AS2 of the second tooth 72 of the control element 21 encounters the first contact face SK1 of pawl 3. The locking element 2 is moved from its standby position, in a clockwise direction in FIG. 20 to FIG. 22. Due to the shape of the corresponding locking faces AS2 and SK1, a rotary movement of the locking element 2 occurs around the first axis B.

Figure 23:
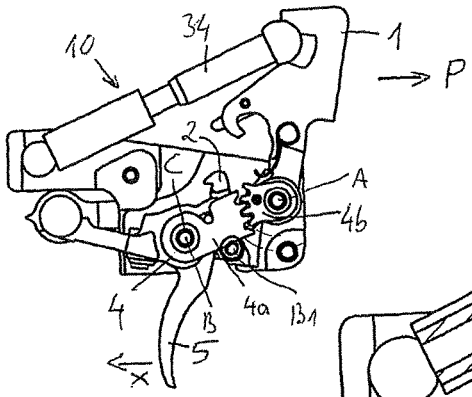
FIG. 23 shows said trigger device fired from the second tooth position.
Figure 24:
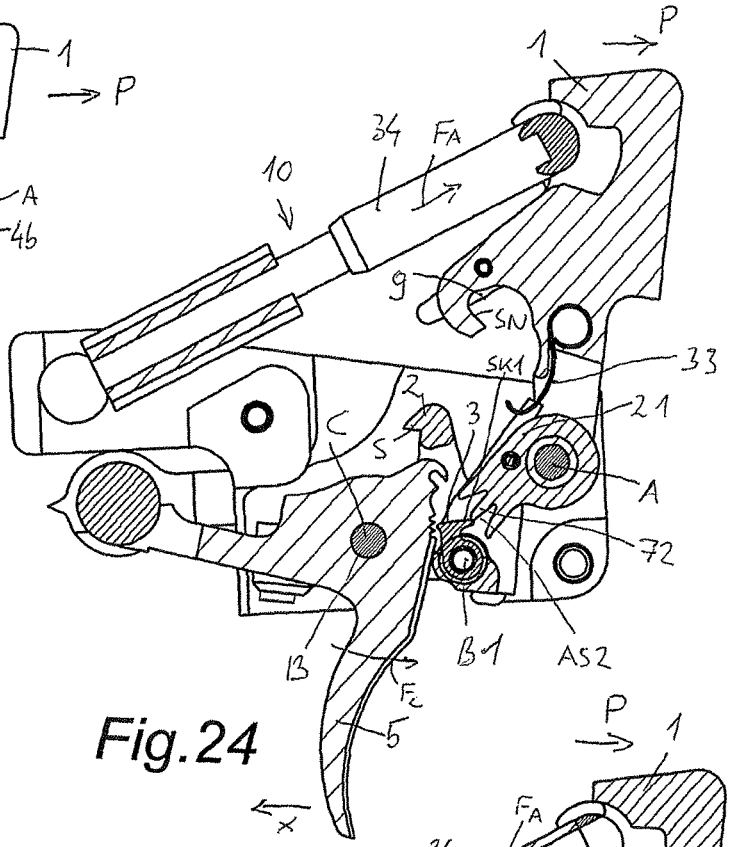
FIG. 24 shows said trigger device fired from the second tooth position with removed sear.
Figure 25:
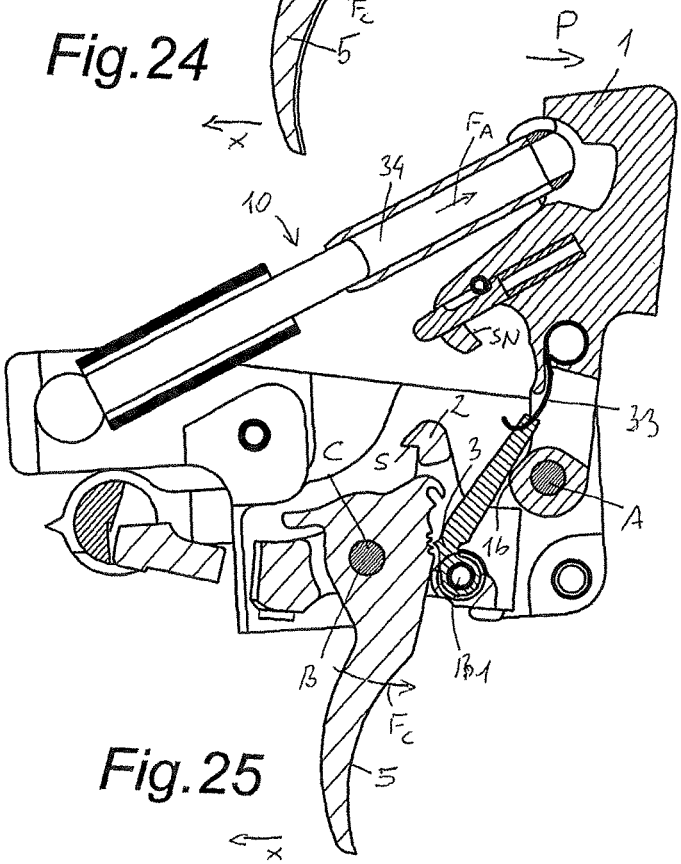
FIG. 25 shows said trigger device fired from the second tooth position with removed control element.

V—Fired 2nd Tooth (FIG. 23 to FIG. 25)

The locking element 2 is rotated around the first axis B in a clockwise direction via the sear 4 due to the continuous force effect of the shooter on the trigger 5, wherein the locking face S of the locking element 2 slides radially to the outside along locking face SN of the latching recess 9 of the trigger element 1 in a clockwise direction in relation to the first axis B, until the locking faces S and SN lose their mutual contact (see FIG. 23 to FIG. 25). The spring-loaded trigger element 1 now begins to turn around pivot point A in a clockwise direction through the spring force $F_A$ and subsequently meets the firing pin (not shown) again, which executes the energy transfer on the percussion cap.

Figure 26:
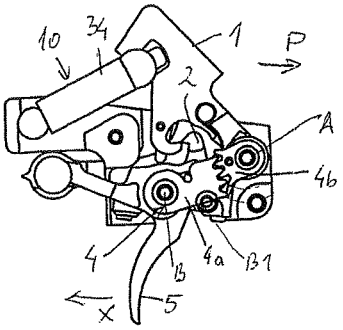
FIG. 26 shows said trigger device with fire discharge from the third tooth position.
Figure 27:
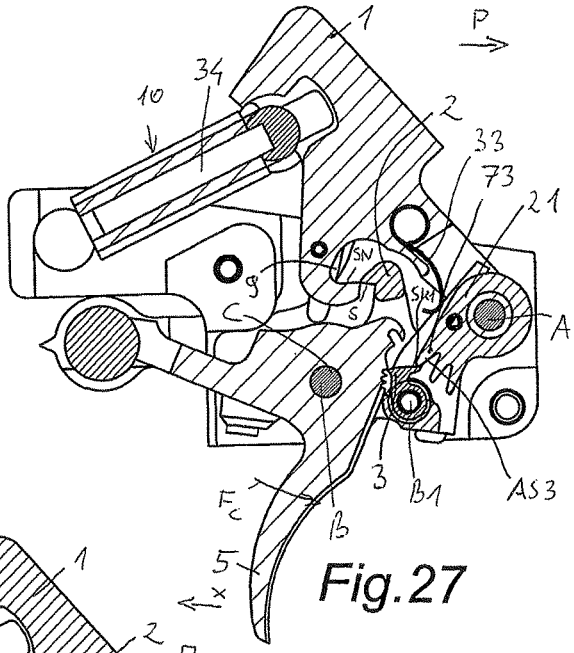
FIG. 27 shows said trigger device with fire discharge from the third tooth position with removed sear.
Figure 28:
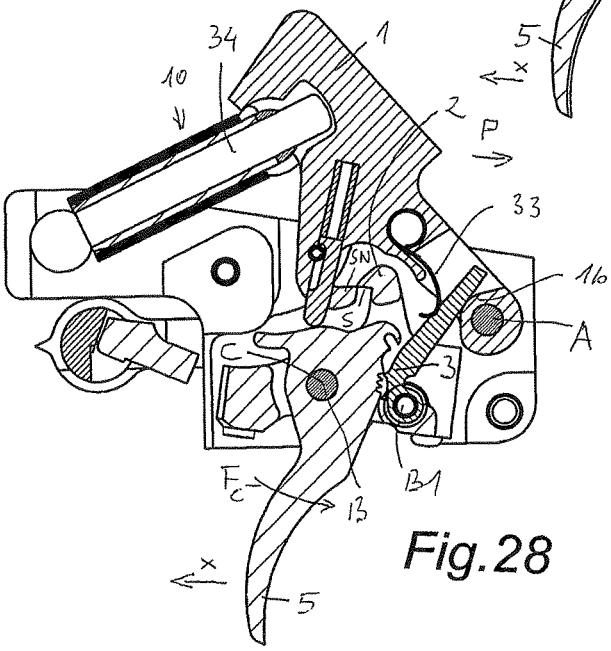
FIG. 28 shows said trigger device with fire discharge from the third tooth position with removed control element.

VI—Firing of 3rd Tooth (FIG. 26 to FIG. 28)

Due to the backward movement of the breech in the X direction, the trigger element 1 is rotated counterclockwise around pivot point A against the spring force $F_A$. Due to the spring load of locking element 2, it is pressed against the trigger element 1 in the clockwise direction. If the movement of the trigger element 1 counterclockwise exceeds the locking face S of locking element 2, the locking element 2 pivots back into the latching recess 9—the locking face S of locking element 2 comes back into contact with the locking face SN of trigger element 1. As soon as the breech moves in the opposite direction in the direction of the barrel, the trigger element 1 is moved in the clockwise direction by the spring force $F_A$, wherein the locking faces S and SN of locking element 2 or of trigger element 1 come back to be positioned on top of each other. The trigger element 1 is now back in its tensioned standby position.

The trigger 5 is moved by the shooter further in the direction x against the spring force $F_C$, wherein it is pivoted clockwise around pivot point C. The trigger 5 begins to move against the spring resetting force $F_C$ around the first axis B together with the first toothed segment 4*a*. In further consequence, the locking face AS3 of the third tooth 73 of the control element 21 meets the first contact face SK1 of pawl 3. The locking element 2 is moved from its standby position in a clockwise direction in FIG. 26 to FIG. 28. Due to the shape of the corresponding locking faces AS3 and SK1, a rotary movement of the locking element 2 occurs around the first axis B.

Figure 29:
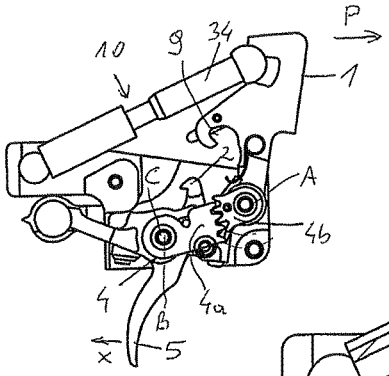
FIG. 29 shows said trigger device fired from the third tooth position.
Figure 30:
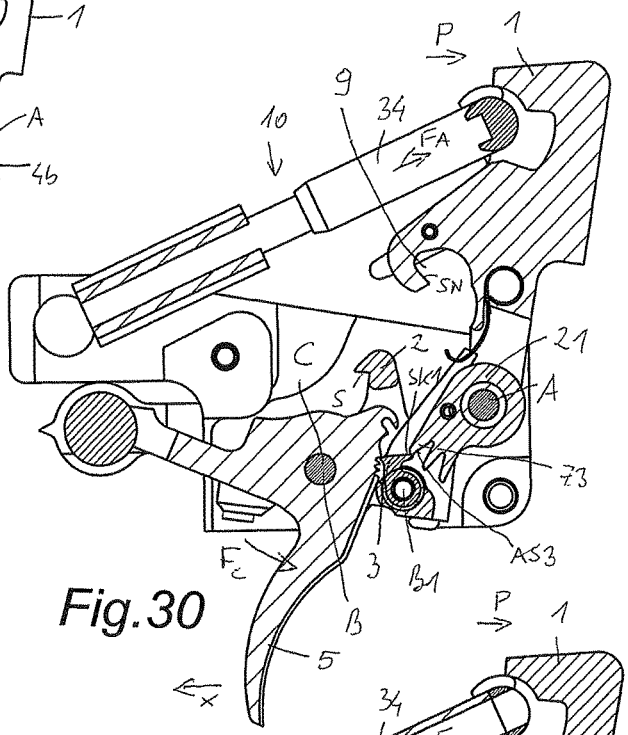
FIG. 30 shows said trigger device fired from the third tooth position with removed sear.
Figure 31:
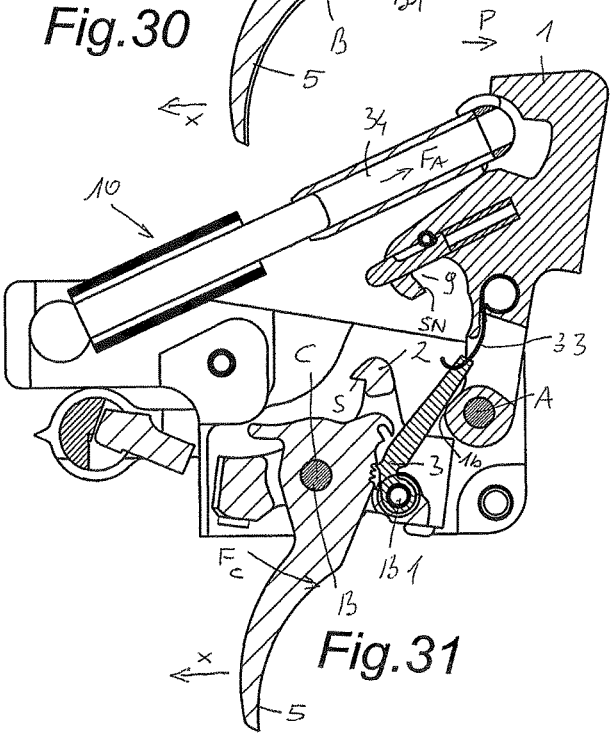
FIG. 31 shows said trigger device fired from the third tooth position with removed control element.

VII—Fired 3rd Tooth (FIG. 29 to FIG. 31)

The locking element 2 is rotated around the first axis B in a clockwise direction via the sear 4 due to the continuous force effect of the shooter on the trigger 5, wherein the locking face S of the locking element 2 slides radially to the outside along the locking face SN of the latching recess 9 of the trigger element 1 in a clockwise direction in relation to the first axis B, until the locking faces S and SN lose their mutual contact (see FIG. 23 to FIG. 25). The spring-loaded trigger element 1 now begins to turn around pivot point A in a clockwise direction through the spring force $F_A$ and subsequently meets the firing pin (not shown) again, which executes the energy transfer on the percussion cap.

Should the trigger process be interrupted by the shooter, wherein the trigger 5 remains in its position or moves around the pivot point C counterclockwise in the direction of its standby position, then the sear 4 is returned to its standby position by spring force, wherein the pawl 3 is force-controlled due to its design and rotated in the clockwise direction around pivot point B1 and slides over the locking faces AS3 to AS1.

I claim:

1. A trigger device for a semi-automatic handgun, comprising a locking element swivel-mounted around a first axis and acting on a triggering element via a locking face, and a shot limitation device, which comprises a control element with at least two locking or control faces defining one locking position each for a pawl swivel-mounted around a second axis, wherein the control element is formed by a sear arranged in a path of action between a trigger and the triggering element, wherein the sear acts on the triggering element through the pawl and the locking element, wherein the pawl is swivel-mounted on the locking element around the second axis.

2. The trigger device according to claim 1, wherein the second axis is spaced from the first axis.

3. The trigger device according to claim 1, wherein the pawl is designed as a two-armed lever, whose first lever arm forms a first contact face cooperating with the locking or control face of the control element and whose second lever arm forms a second contact face cooperating with a control face of the triggering element.

4. The trigger device according to claim 1, wherein the sear is arranged separate from the trigger.

5. The trigger device according to claim 4, wherein the sear is operatively connected with the trigger through a transmission element.

6. The trigger device according to claim 5, wherein the transmission element is designed as a single-sided transmission lever.

7. The trigger device according to claim 4, wherein the trigger is operatively connected with the sear or the transmission element through a pressure nose.

8. The trigger device according to claim 1, wherein the sear is slidably mounted in a housing.

9. The trigger device according to claim 1, wherein the sear is swivel-mounted in a housing.

10. The trigger device according to claim 9, wherein the triggering element and the sear are swivel-mounted around the same pivot point.

11. The trigger device according to claim 1, wherein the locking element is swivel-mounted on the sear.

12. The trigger device according to claim 1, wherein the locking element is swivel-mounted in a housing.

13. The trigger device according to claim 1, wherein the control element has a toothed segment with at least two locking teeth defining the locking positions.

14. The trigger device according to claim 1, wherein the control element has a sliding guide with at least two sliding deflectors defining the locking positions.

15. The trigger device according to claim 14, wherein a sliding block is arranged on the first lever arm of the pawl, which sliding block is forcibly guided in the sliding guide.

16. The trigger device according to claim 1, wherein the sear is designed to have multiple parts.

17. The trigger device according to claim 16, wherein the sear has a first toothed segment non-rotatably connected with the trigger and a second toothed segment non-rotatably connected with the control element, which second toothed segment is in toothed meshing with the first toothed segment.

* * * * *